US012745830B2

(12) United States Patent
Wei et al.

(10) Patent No.: US 12,745,830 B2
(45) Date of Patent: Sep. 29, 2026

(54) PACKSACK DAMPING MODULE AND PACKSACK

(71) Applicants: SANLIUYIDU(CHINA)CO., LTD., Quanzhou (CN); SANLIUYIDU(FUJIAN)SPORTS GOODS CO., LTD., Quanzhou (CN); 361 DEGREES KIDS WEAR LIMITED, Quanzhou (CN)

(72) Inventors: Shutao Wei, Quanzhou (CN); Dejia Wei, Quanzhou (CN); Qingjing Zhou, Quanzhou (CN); Pengju Fu, Quanzhou (CN)

(73) Assignees: SANLIYIDU(CHINA)CO., LTD., Quanzhou (CN); SANLIUYIDU(FUJIAN)SPORTS GOODS CO., LTD., Quanzhou (CN); 361 DEGREES KIDS WEAR LIMITED, Quanzhou (CN)

( * ) Notice: Subject to any disclaimer, the term of this patent is extended or adjusted under 35 U.S.C. 154(b) by 102 days.

(21) Appl. No.: 18/674,714

(22) Filed: May 24, 2024

(65) Prior Publication Data

US 2024/0306799 A1 Sep. 19, 2024

Related U.S. Application Data

(63) Continuation of application No. PCT/CN2023/095776, filed on May 23, 2023.

(30) Foreign Application Priority Data

Sep. 26, 2022 (CN) ..... 202211176470.4

(51) Int. Cl.
*A45F 3/04* (2006.01)
*A45F 3/12* (2006.01)

(52) U.S. Cl.
CPC ..... *A45F 3/04* (2013.01); *A45F 3/12* (2013.01); *A45F 3/047* (2013.01); *A45F 2003/122* (2013.01)

(58) Field of Classification Search
CPC .. A45F 3/04; A45F 3/042; A45F 3/047; A45F 2003/122; F16F 3/04; F16F 15/067
(Continued)

(56) References Cited

U.S. PATENT DOCUMENTS 335,252 A * 2/1886 Spooner ..... F16F 1/04 267/73
1,026,566 A * 5/1912 Cutler ..... B60C 27/12 267/72

(Continued)

FOREIGN PATENT DOCUMENTS

AU 2023359306 A1 * 5/2025 ..... A45F 3/12
CN 101406343 B * 12/2010 ..... A45F 3/12

(Continued)

OTHER PUBLICATIONS

International search report of PCT/CN2023/095776.

*Primary Examiner* — Justin M Larson

(57) ABSTRACT

Disclosed packsack damping module and packsack, comprises a housing, a first movable member, a second movable member and an elastic element, the housing is internally provided with a mounting cavity; the first movable member and the second movable member are both provided in the mounting cavity; the first movable member is connected with one end of the elastic element, the other end of the elastic element is connected with the second movable member; or the elastic element is provided with the first elastic member and the second elastic member, one end of the first elastic member is connected with the first movable member, the other end of the first elastic member is connected with the housing, one end of the second elastic member is
(Continued)

connected with the first movable member, the other end of the second elastic member is connected with the housing. The disclosure improves the damping effect.

18 Claims, 13 Drawing Sheets

(58) Field of Classification Search
USPC ..... 267/67, 69, 70, 71, 73, 74, 136; 224/627–659; 248/565
See application file for complete search history.

(56) References Cited

U.S. PATENT DOCUMENTS 1,364,427 A * 1/1921 Corey ..... A41F 11/04 267/71
1,388,241 A * 8/1921 Dierking ..... A44B 11/008 267/70
1,471,121 A * 10/1923 Grasnick ..... A41F 3/045 267/72
1,690,957 A * 11/1928 Tommins ..... D06F 53/00 267/74
4,488,511 A * 12/1984 Grassano ..... A01K 27/005 119/798
4,681,303 A * 7/1987 Grassano ..... B68B 1/00 267/113
5,803,439 A * 9/1998 Gilmore ..... F16F 1/00 707/74
5,884,827 A * 3/1999 Stein ..... A63B 55/00 267/71
5,915,608 A * 6/1999 Mao ..... A45F 5/02 224/616
6,619,523 B1 9/2003 Duckworth
7,966,049 B2 * 6/2011 Jang ..... H04M 1/0237 455/90.3
8,265,720 B2 * 9/2012 Ahn ..... H04M 1/0237 455/575.4
8,366,081 B2 * 2/2013 Staihar ..... A45F 3/14 267/69
8,851,459 B2 * 10/2014 Hsu ..... F16F 3/04 455/575.4
9,277,034 B2 * 3/2016 Hazama ..... H04M 1/0237
11,253,047 B1 * 2/2022 Rome ..... A45F 3/10
2006/0151559 A1 * 7/2006 Gravseth ..... A45F 3/04 224/641
2008/0254844 A1 * 10/2008 Lee ..... H04M 1/0237 455/575.4
2010/0113110 A1 * 5/2010 Lee ..... H04M 1/0237 455/575.4
2013/0285297 A1 * 10/2013 Hsu et al. ..... F16F 3/00 267/73
2024/0306799 A1 * 9/2024 Wei ..... A45F 3/04

FOREIGN PATENT DOCUMENTS

CN 210446058 U 5/2020
CN 210747837 U * 6/2020
CN 111955895 A 11/2020
CN 112806705 A * 5/2021 ..... A45F 3/04
CN 110269379 B * 6/2021 ..... H02N 1/06
CN 113323931 A * 8/2021 ..... F15B 11/16
CN 214547930 U 11/2021
CN 215125225 U 12/2021
CN 113995222 A * 2/2022 ..... A45F 3/12
CN 114081263 A * 2/2022 ..... F16F 15/027
CN 216165829 U 4/2022
CN 114521730 A * 5/2022 ..... A45F 3/08
CN 114732203 A * 7/2022 ..... A45C 13/007
CN 108835848 B * 11/2022 ..... A45F 3/042
CN 115363329 A * 11/2022 ..... A45C 13/00
CN 218008624 U * 12/2022
CN 114081263 B * 4/2023 ..... A45F 3/08
CN 218999756 U 5/2023
CN 219460549 U * 8/2023 ..... A45F 3/04
CN 117397925 A * 1/2024 ..... A45F 3/04
CN 117796614 A * 4/2024 ..... A45F 3/12
CN 221003625 U * 5/2024 ..... A45F 3/04
CN 118415445 A * 8/2024 ..... A45F 3/12
DE 202013004306 U1 * 8/2014 ..... A45F 13/10
EP 3685701 A1 * 7/2020 ..... A45F 3/04
EP 4595813 A1 * 8/2025 ..... A45F 3/12
JP 2005046561 A * 2/2005
KR 20140007036 A * 1/2014 ..... A45C 13/10
NO 322177 B1 * 8/2006 ..... A45F 3/04
WO WO-2024066408 A1 * 4/2024 ..... A45F 3/12
WO WO-2024077515 A1 * 4/2024 ..... A45F 3/04
WO WO-2024078641 A1 * 4/2024 ..... A45F 3/04
WO WO-2025051210 A1 * 3/2025 ..... A45F 3/04

* cited by examiner

PACKSACK DAMPING MODULE AND PACKSACK

CROSS REFERENCE

The present application is a continuation-application of International (PCT) Patent Application No. PCT/CN2023/095776, filed on May 23, 2023, which claims priority of Chinese Patent Applications No. 202211176470.4 filed on Sep. 26, 2022, the entire contents of which are hereby incorporated by reference in their entirety.

TECHNICAL FIELD

The present disclosure herein belongs to the field of packsack, in particular to a packsack damping module and packsack thereof.

BACKGROUND

According to the demand of market product trends, packsack added damping function, damping module can effectively reduce the impact of walking to the shoulder, whereby consumers bring intuitive feeling is more labor-saving.

Patent application with publication number CN108835848A discloses a buffer damping packsack, wherein a buffer spring is installed in a box body, and the box body is fixedly connected with a shoulder girdle; when a human body is in the packsack, the shoulder girdle shakes left and right, whereby the spring shakes while deforming at the upper and lower parts of the box body, and the damping effect is poor; in addition, the spring generates noise by friction with the housing in the deformation process, resulting in poor experience feeling; and only one end of the shoulder girdle can play a damping role.

TECHNICAL PROBLEMS

The existing packsack has no damping function or poor damping effect and loud noise.

TECHNICAL SOLUTIONS

The present disclosure aims to provide a packsack damping module and a packsack to improve damping effect.

To achieve this purpose, the present disclosure adopts the following technical scheme: the packsack damping module provided by the present disclosure comprises a housing, a movable element and an elastic element, wherein the housing is internally provided with a mounting cavity; the movable element comprising at least one first movable member movable towards one side of the housing and at least one second movable member movable towards the other side of the housing; the first movable member and the second movable member are both provided in the mounting cavity; and the first movable member is connected with the second movable member through the elastic element.

Preferably, both opposite sides of the mounting cavity are provided with an opening, the first movable member that pass through the opening on one side of the mounting cavity moves out of/into the mounting cavity, and the second movable member that pass through the opening on other side of the mounting cavity moves out of/into the mounting cavity.

Preferably, the first movable member and the second movable member both comprise a connecting portion, a hook and a guide post, wherein at least one end of the connecting portion is connected with the guide post, one side of the connecting portion is connected with the hook, the housing is provided with a guide groove for the sliding connection of the guide post, and the hook is connected with the elastic element.

Preferably, the guide groove is internally provided with a limiting wall; when the first movable member moves towards the second movable member, the guide post of the first movable member is blocked by the limiting wall when sliding to the lower part of the guide groove; and when the second movable member moves towards the first movable member, the guide post of the second movable member is blocked by the limiting wall when sliding to the upper part of the guide groove.

Preferably, the connecting portion, the hook, and the guide post are integrally formed.

Preferably, the hook is provided with at least one hanging portion, and each hook is connected with the elastic elements with the same number as the hanging portion.

Preferably, the elastic element is a spring and at least two are provided; when there are one of the first movable member/the second movable member, there is at least one hanging portion of the first movable member/the second movable member; and when there are at least two of the first movable member/the second movable member, there is at least one hanging portion of each of the first movable member/the second movable member.

Preferably, the housing comprises a front housing and a rear housing, wherein the middle of the rear housing is provided with a connecting boss, the connecting boss is positioned between the spring and the guide groove, and the connecting boss is provided with a plurality of positioning holes, the inner side of the front housing is provided with a positioning post, and the positioning post is inserted into the positioning hole.

Preferably, the guide post is cylindrical, and the guide groove comprises a first circular arc guide groove arranged on the rear housing and a second circular arc guide groove arranged on the front housing, a circular groove is enclosed between the first circular arc guide groove and the second circular arc guide groove, the guide post is provided in the circular groove, and the limiting wall is provided at the bottom end of the first circular arc guide groove and/or the second circular arc guide groove.

Preferably, the front housing is provided with an escape groove at the position of the spring.

Preferably, a display block for displaying the position of the guide post is installed at the end of the guide post of the first movable member, and the front housing is partially transparent or fully transparent.

The present disclosure further provide the other packsack damping module, comprising a housing, a movable element and an elastic element, the housing is internally provided with a mounting cavity, the movable element comprising at least one first movable member movable towards one side of the housing and at least one second movable member movable towards the other side of the housing, the first movable member and the second movable member are both provided in the mounting cavity, the elastic element is provided with a first elastic member and a second elastic member, one end of the first elastic member is connected with the first movable member, and the other end of the first elastic member is connected with the housing, and one end of the second elastic member is connected with the second movable member, and the other end of the second elastic member is connected with the housing.

Preferably, the first movable member and the second movable member both comprise a connecting portion, a hook and a guide post, at least one end of the connecting portion is connected with the guide post, one side of the connecting portion is connected with the hook, the housing is provided with a guide groove for the sliding connection of the guide post, and the hook is connected with the elastic element.

Preferably, the hook is provided with at least one hanging portion, and each hook is connected with the elastic elements with the same number as the hanging portion.

Preferably, the elastic element is a spring and at least four are provided; when there are one of the first movable member/the second movable member, there is at least two hanging portions of the first movable member/the second movable member; and when there are at least two of the first movable member/the second movable member, there is at least one hanging portion of each of the first movable member/the second movable member.

The present disclosure further provides a packsack, comprising a packsack body, a shoulder girdle and the first packsack damping module/the second packsack damping module mentioned above, wherein the housing is fixed on the packsack body, and the upper and lower ends of the shoulder girdle are respectively connected with the first movable member and the second movable member.

Preferably, the packsack body comprises a first rear panel and a second rear panel positioned inside, and the housing is fixed between the first rear panel and the second rear panel.

Preferably, the present disclosure further comprises a connecting plate, the upper end of the shoulder girdle is connected with the upper end of the first movable member through the connecting plate, and the lower end of the shoulder girdle is connected with the lower end of the second movable member through the connecting plate, the inner side of the connecting plate is provided with a vertical strip, both ends of the vertical strip are fixed on the connecting plate, the outer side of the second rear panel is provided with a horizontal strip, both ends of the horizontal strip are fixed on the second rear panel, and the middle of the horizontal strip penetrates through the vertical strip, whereby the vertical strip moves up and down in the middle of the horizontal strip.

Preferably, the first movable member and the second movable member have the same structure and are both provided with a connecting portion, the connecting portion is provided with a connecting groove, one side of the connecting plate is provided with a connecting ring, and the connecting ring is hooked in the connecting groove.

Preferably, both sides of the middle of the horizontal strip are vertically sewn and fixed on the second rear panel, whereby the relationship between the width a of the middle of the horizontal strip and the width b of the vertical strip is a−b=4−20 mm.

Preferably, both sides of the connecting plate are provided with inclination angles, two shoulder girdles are arranged in total, and two shoulder girdles are connected to the inclination angle.

Preferably, the housing comprises a front housing and a rear housing, wherein the middle of the rear housing is provided with a plurality of positioning holes; the inner side of the front housing is provided with a positioning post, the positioning post is inserted and penetrates through the positioning hole, the end part of the positioning post is provided with an opening, and the opening part of the positioning post is connected with the second rear panel through a plug pin.

BENEFICIAL EFFECTS

1. Through the setting of the first movable member and the first movable member combined with the elastic element, the two-way damping is realized, and the damping effect is good.
2. In the case of shared springs, only two springs are needed to achieve a good damping effect, both the upper and lower damping effect.
3. In the case of no shared springs, the first movable member and the second movable member each use their own spring, which can also achieve good damping effect; relative to the case of shared springs, it needs to increase the number of springs, however, relative to the case of shared springs, the spring replacement of the first movable member and the second movable member can be replaced separately and not affect each other.
4. Through the setting of the front housing and the back housing, it is convenient to disassemble the first movable member, the second movable member and the spring, and when the spring is damaged or needs to replace the damping load, only the front housing needs to be disassembled to replace the spring.
5. The hook is provided with two hanging portions on the left and right, with two corresponding springs, the spring and the guide post are all vertically provided to form the double-guide double-spring damping system, the damping effect is better than that of the single-spring structure.
6. The connecting boss is provided between the spring and the guide groove, the spring is separated in a large independent activity space, and the connecting boss is positioned in the middle of the housing, which can improve the connecting strength of the housing.
7. Through the setting of the escape groove, the spring has certain space when stretching, preventing the friction between the spring and the housing from producing noise.
8. Through the setting of the display block, when the first movable member moves, the position of the movement can be clearly seen through the display block.
9. The relationship between the width a of the middle of the horizontal strip and the width b of the vertical strip is a−b=4−20 mm; by setting this size relation, the connecting plate can move only in the vertical direction, so as to prevent lateral movement of the knapsack damping module and improve its stability.
10. Through the setting of the inclination angle, making the shoulder girdle set more in line with the principles of Ergonomics.
11. Through the coordination of the upper and lower ends of the shoulder girdle with the first movable member and the second movable member respectively, the damping treatment is carried out from the upper and lower directions, thereby greatly reducing the impact force brought to the shoulder by walking, thus achieving the effect of relieving the pressure, and the effect is better than the shoulder girdle single-end damping.

DETAILED DESCRIPTION OF THE EMBODIMENTS

Figure 1:
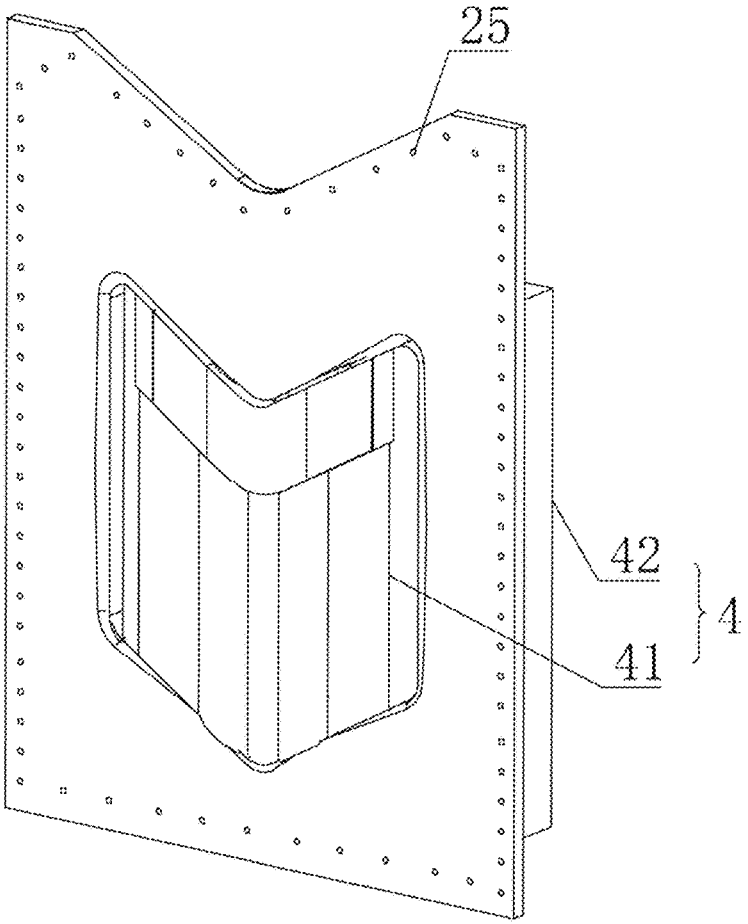
FIG. 1 is a three-dimensional structure schematic diagram of a housing according to Example 1 of the present disclosure.
Figure 2:
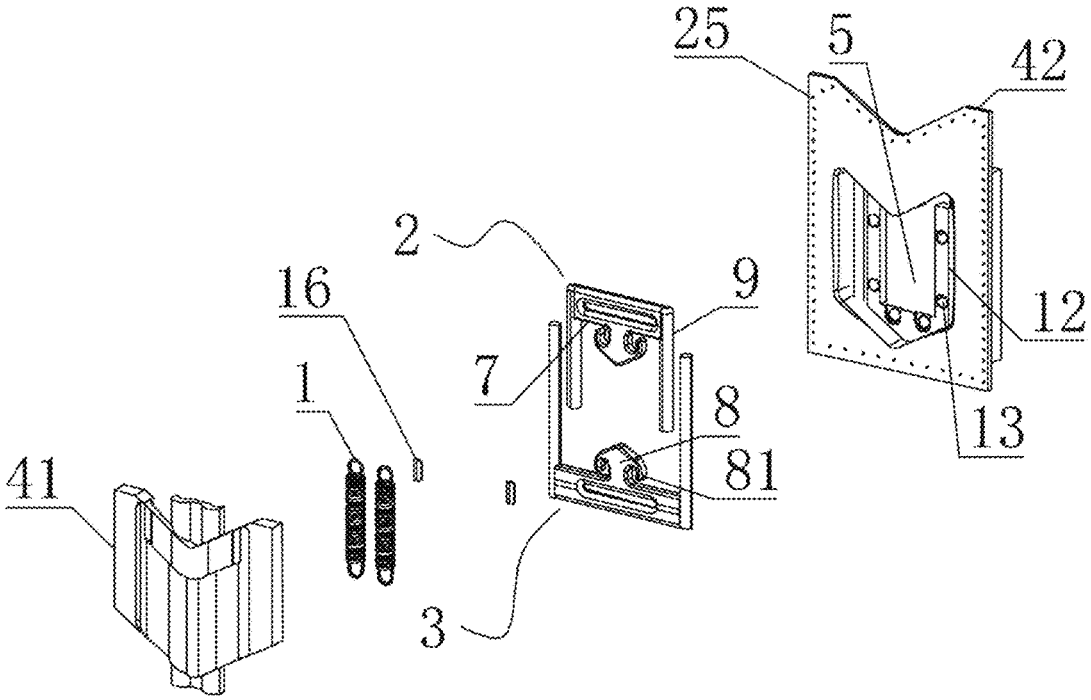
FIG. 2 is a three-dimensional explosion structure schematic diagram of a packsack damping module according to Example 1 of the present disclosure.
Figure 3:
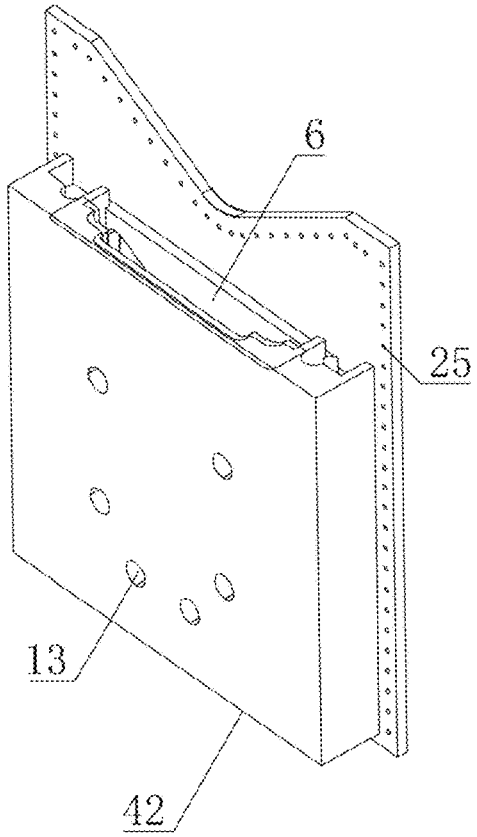
FIG. 3 is a three-dimensional structure schematic diagram of a rear housing according to Example 1 of the present disclosure (first perspective).
Figure 4:
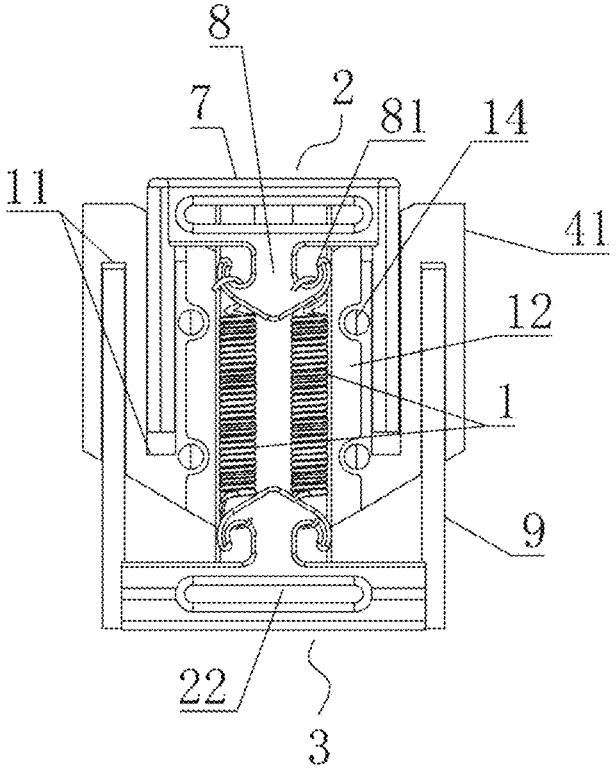
FIG. 4 is a rear view structure schematic diagram of a packsack damping module according to Example 1 of the present disclosure (excluding a rear housing).
Figure 5:
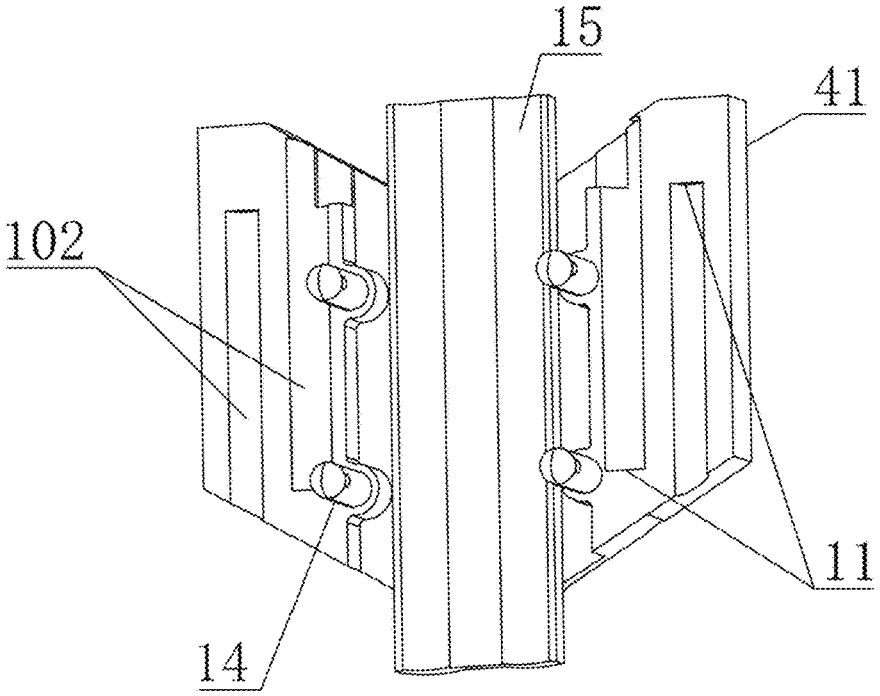
FIG. 5 is a three-dimensional structure schematic diagram of a front housing according to Example 1 of the present disclosure.
Figure 6:
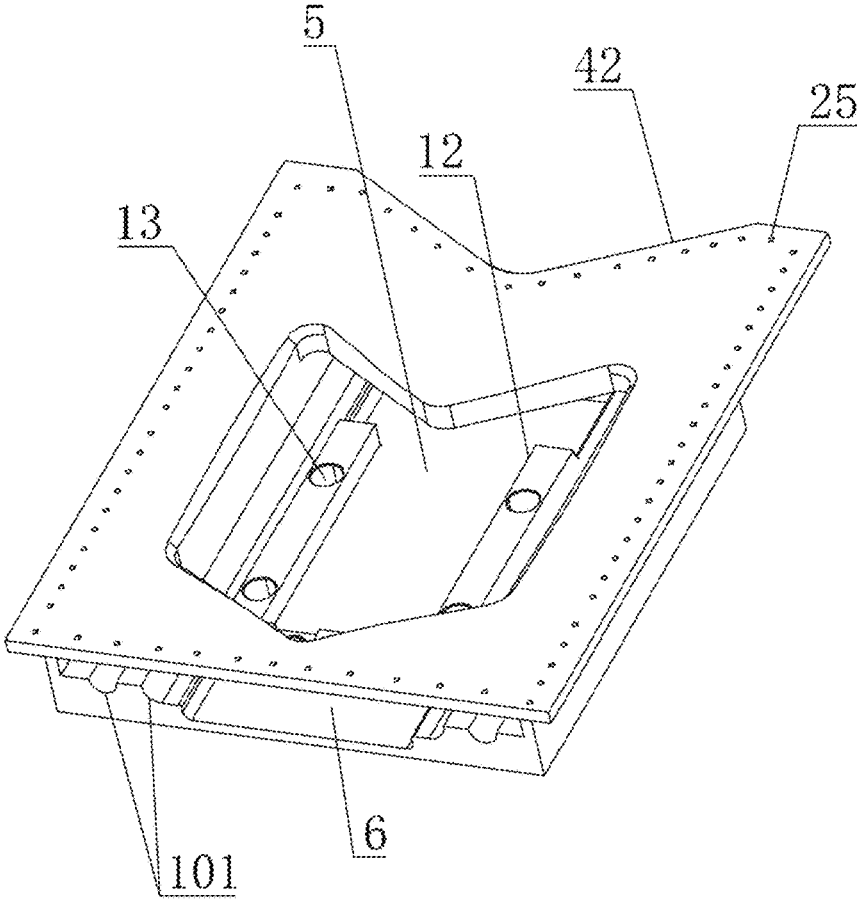
FIG. 6 is a three-dimensional structure schematic diagram of a rear housing according to Example 1 of the present disclosure (second perspective).
Figure 7:
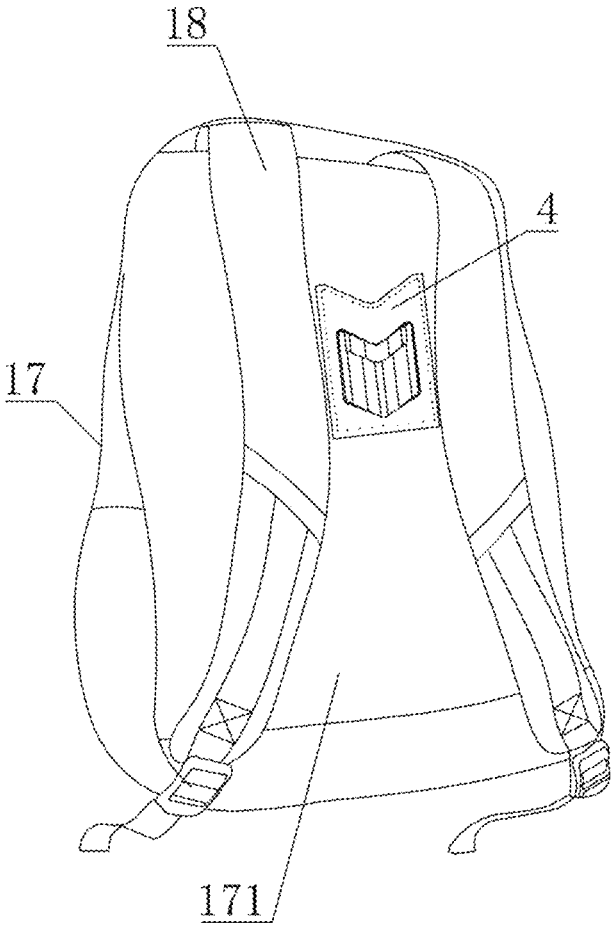
FIG. 7 is a three-dimensional structure schematic diagram of a packsack according to Example 2 of the present disclosure.
Figure 8:
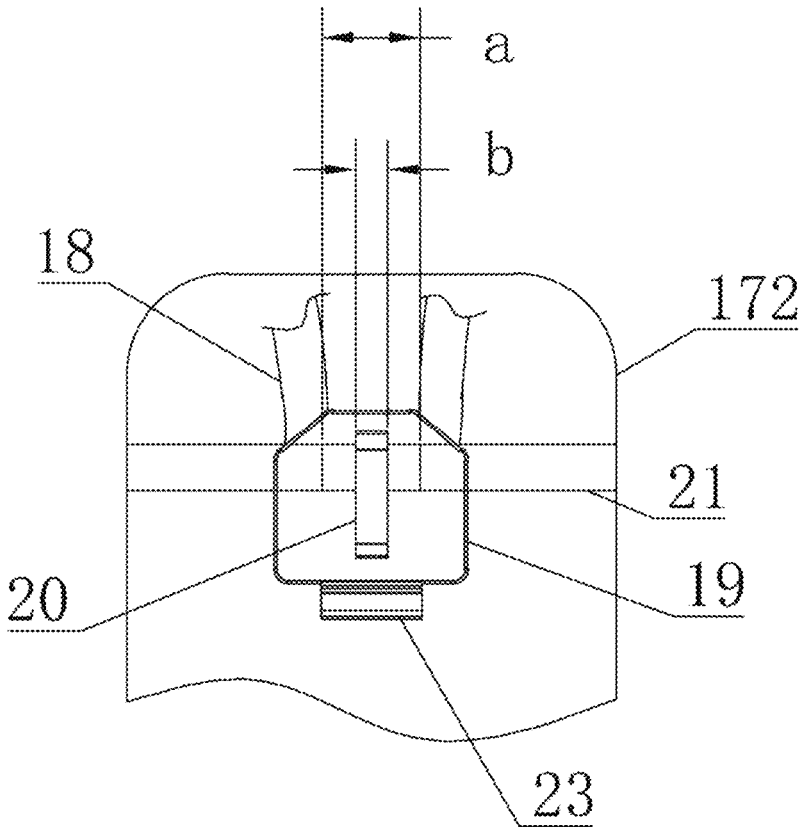
FIG. 8 is a matching structure schematic diagram of a second rear panel, a connecting plate, a horizontal strip and a vertical strip according to Example 2 of the present disclosure.
Figure 9:
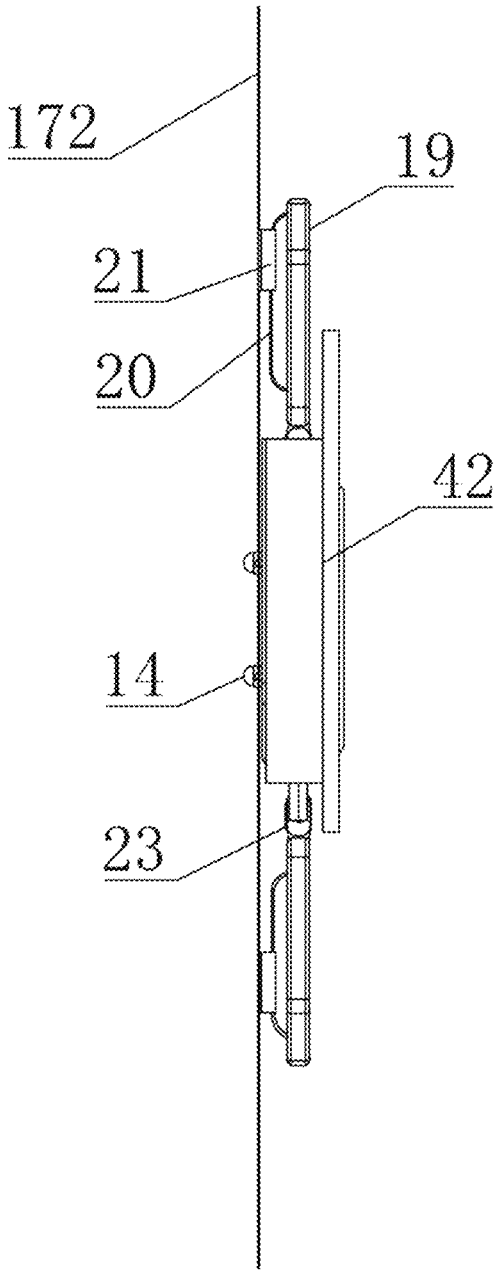
FIG. 9 is a left side view schematic diagram of a second rear panel, a connecting plate, a horizontal strip, a vertical strip and a packsack damping module according to Example 2 of the present disclosure (initial state).
Figure 10:
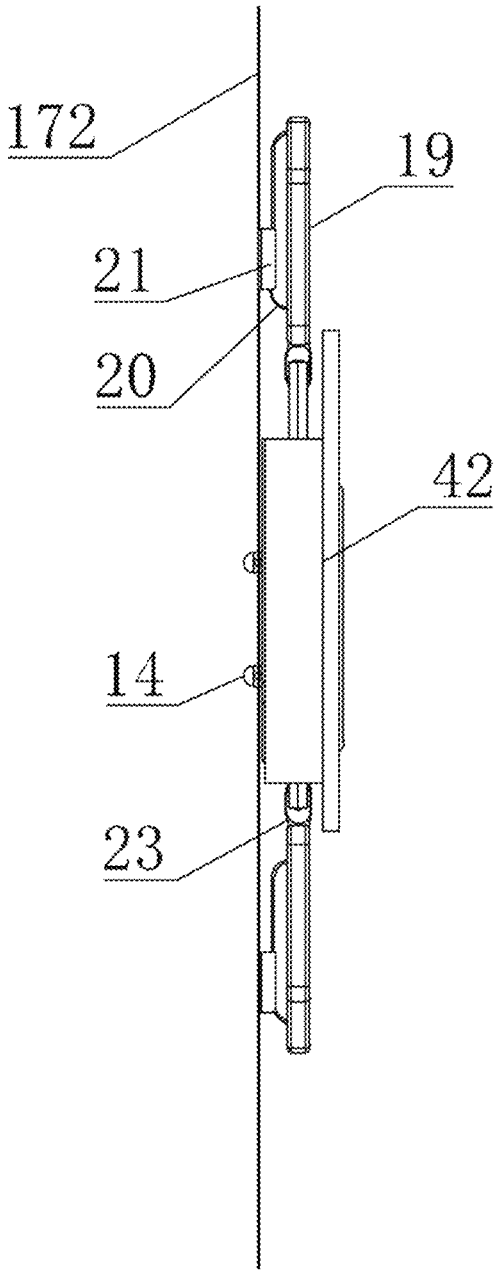
FIG. 10 is a left side view schematic diagram of a second rear panel, a connecting plate, a horizontal strip, a vertical strip and a packsack damping module according to Example 2 of the present disclosure (first movable member moves upward).
Figure 11:
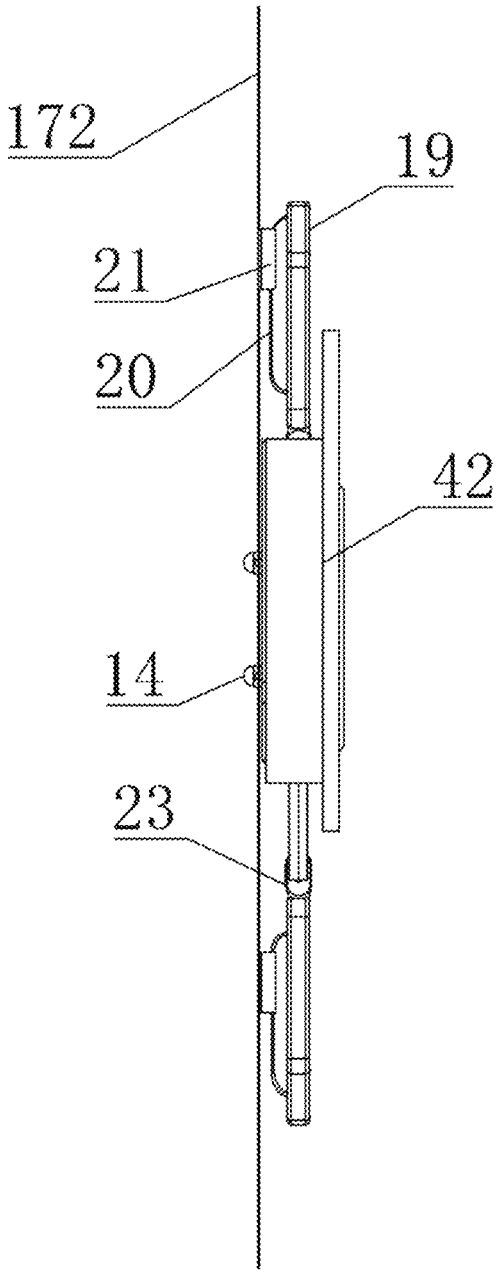
FIG. 11 is a left side view schematic diagram of a second rear panel, a connecting plate, a horizontal strip, a vertical strip and a packsack damping module according to Example 2 of the present disclosure (second movable member moves downward).
Figure 12:
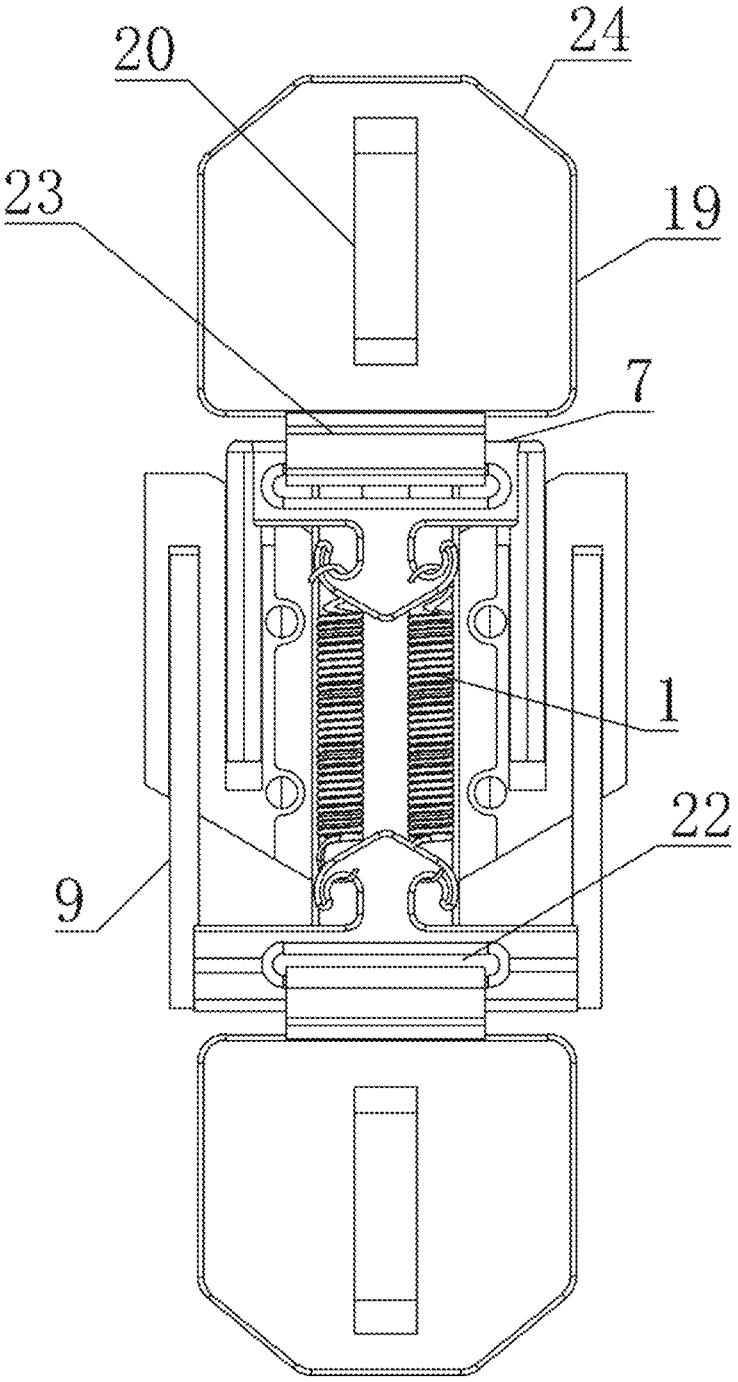
FIG. 12 is a rear view structure schematic diagram of a packsack damping module, a connecting ring, a connecting plate and a vertical strap according to Example 2 of the present disclosure (excluding a rear housing).
Figure 13:
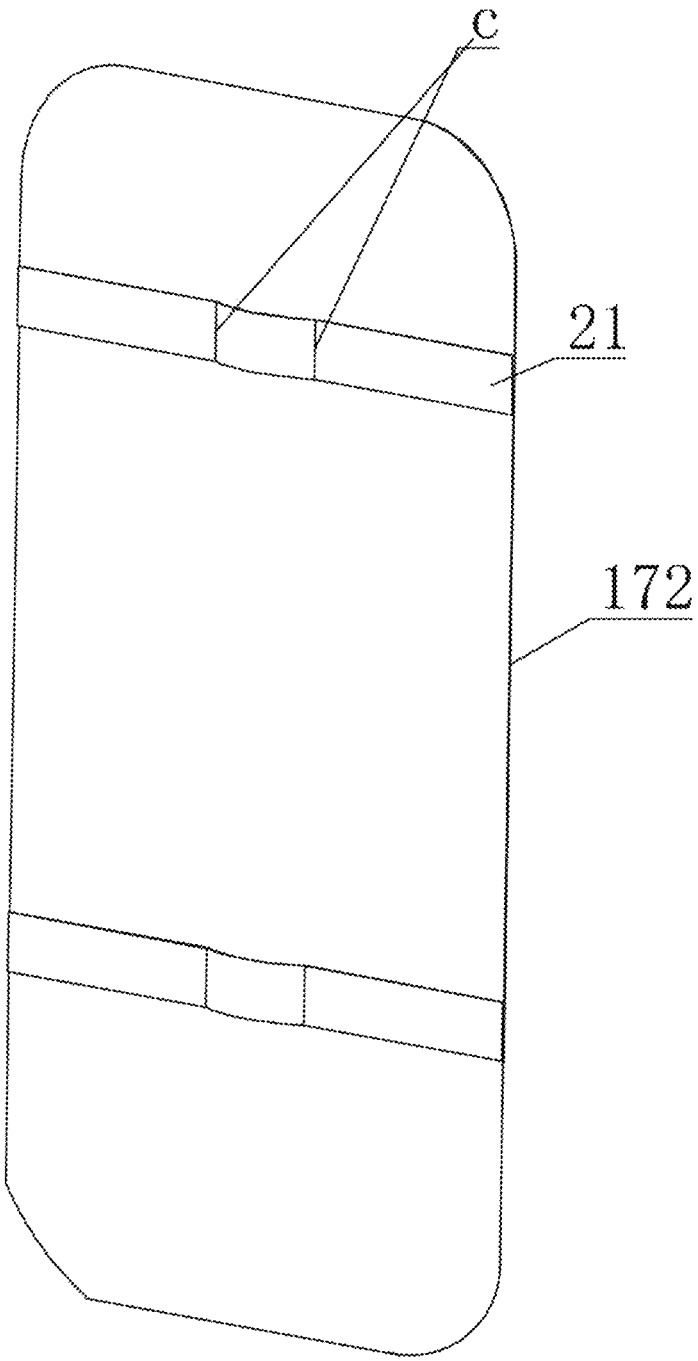
FIG. 13 is a three-dimensional structure schematic diagram of a second rear and a horizontal stripe according to Example 2 of the present disclosure.

The invention is further explained in combination with the accompanying drawings and the specific embodiment.

The contents not described in detail in this specification belong to the prior art known to those skilled in the art. In the description of the present disclosure, it is understood that, the terms "Center", "Top", "Bottom", "Front", "Rear", "Left", "Right", "Vertical", "Level", "Top", "Bottom", "Inside", "Outside", "Clockwise", "Counter-clockwise", etc. indicate a position or position relationship based on the position or position relationship shown in the accompanying drawings, for the sole purpose of facilitating and simplifying the description of the present disclosure, and not to indicate or imply that the device or element referred to must have a specific orientation, be constructed and operated in a specific orientation, therefore, it can not be understood as a limitation of the present disclosure. In addition, the terms "First, ""Second,""Third," and so on are used only to distinguish between descriptions and can not be understood as indicating or hinting the relative importance.

Example 1 as shown in FIGS. 1 to 6, the packsack damping module provided in this example comprises a housing 4, a movable element and an elastic element, wherein the movable element of this example comprises a first movable member 2 that moving upwards and a second movable member 3 that moving downwards, the second movable member 3 is positioned below the first movable member 2, the housing 4 comprises a front housing 41 and a rear housing 42, the elastic element is a spring 1 and is provided with two springs 1, the two springs 1 are provided in a left-right distribution. Of course, in other embodiments, the housing 4 can also be made integral; in this example, through the setting of the front housing 41 and the back housing 42, it is convenient to disassemble the first movable member 2, the second movable member 3 and the spring 1, and when the spring 1 is damaged or needs to replace the damping load, only the front housing 41 needs to be disassembled to replace the spring 1.

The front housing 41 and the back housing 42 is internally provided with a mounting cavity 5, the upper and lower sides of the mounting cavity 5 is provided with an openings 6. The first movable member 2 and the second movable member 3 are both provided in the mounting cavity 5, the first movable member 2 that pass through the upper opening of the mounting cavity 5 moves out of/into the mounting cavity 5, the second movable member 3 that pass through the lower opening of the mounting cavity 5 moves out of/into the mounting cavity 5, the first movable member 2 is connected with the upper ends of the two springs 1, the lower ends of the two springs 1 are connected with the second movable member 3; in this example, the first movable member 2 and the second movable member 3 share the spring 1. In the case of shared springs 1, only two springs 1 are needed to achieve a good damping effect, both the upper and lower damping effect.

The first movable member 2 and the second movable member 3 both comprise a connecting portion 7, a hook 8 and a guide post 9, both left and right ends of the connecting portion 7 are connected with the guide post 9, the inner side of the connecting portion 7 is connected with the hook 8, the housing 4 is provided with a guide groove for the sliding connection of the guide post 9, and the hook 8 is connected with the spring 1. The connecting portion 7, the hook 8 and the guide post are integrally formed. Of course, in other embodiments, the hook 8 and guide post 9 can also be fixedly connected to the connecting portion 7 through connectors. The first movable member 2 and the second movable member 3 are internally provided in the mounting cavity 5, the guide post 9 is cylindrical, the guide groove comprises a first circular arc guide groove 101 arranged on the rear housing 42 and a second circular arc guide groove 102 arranged on the front housing 41, a circular groove is enclosed between the first circular arc guide groove 101 and the second circular arc guide groove 102, the guide post 9 is provided in the circular groove, the circular groove for the sliding connection of the guide post 9. In this example, the hook 8 is provided with two hanging portions 81 on the left and right, with two corresponding springs 1, the spring 1 and the guide post 9 are all vertically provided to form the double-guide double-spring damping system, the damping effect is better than that of the single-spring 1 structure.

The middle of the rear housing 42 is provided with a connecting boss 12, the connecting boss 12 is positioned between the spring 1 and the guide groove, and the connecting boss 12 is provided with a plurality of positioning holes 13. The inner side of the front housing 41 is provided with a positioning post 14, and the positioning post 14 is inserted into the positioning hole 13. The connecting boss 12 is provided between the spring 1 and the guide groove, the spring 1 is separated in a large independent activity space, and the connecting boss 12 is positioned in the middle of the housing 4, which can improve the connecting strength of the housing 4.

The guide groove is internally provided with a limiting wall 11, in this example, the limiting wall 11 is provided at the bottom end of the second circular arc guide groove 102. When the first movable member 2 moves towards the second movable member 3 (when moving downwards), the guide post 9 of the first movable member 2 is blocked by the limiting wall 11 when sliding to the lower part of the guide groove; when the second movable member 3 moves towards the first movable member 2 (when moving upwards), the guide post 9 of the second movable member 3 is blocked by the limiting wall 11 when sliding to the upper part of the guide groove. When the second movable member 3 moves downwards, the second movable member 3 will pull the first movable member 2 to move downwards together for a short distance through the spring 1, so that the guide post 9 connected with the first movable member 2 moves downwards until it abuts against the limiting wall 11, the first movable member 2 cannot move downwards, the second movable member 3 continues to move downwards, and the spring 1 is stretched and deformed. Similarly, when the first movable member 2 moves upwards, the first movable member 2 will pull the second movable member 3 to move upwards together for a short distance through the spring 1, so that the guide post 9 connected with the second movable member 3 moves upwards until it abuts against the limiting wall 11, the second movable member 3 cannot move upwards, the first movable member 2 continues to move upwards, and the spring 1 is stretched and deformed, thus achieving a good double-directional damping effect.

The front housing 41 is provided with an escape groove 15 at the position of the spring 1. Through the setting of the escape groove 15, the spring 1 has certain space when stretching, preventing the friction between the spring 1 and the housing 4 from producing noise.

A display block 16 for displaying the position of the guide post 9 is installed at the end of the guide post 9 of the first movable member 2, the front housing 41 is partially transparent or fully transparent. The position of the display block 16 can be seen through the transparent area of the front housing 41, the display block 16 can be provided with fluorescent material, or conspicuous red material, etc., and when the first movable member 2 moves, the position of the movement can be clearly seen through the display block 16.

Example 2 as shown in FIGS. 7 to 13, the present disclosure further provides a packsack, comprising a packsack body 17, a shoulder girdle 18 and the packsack damping module of Example 1.

The packsack body 17 comprises a first rear panel 171 and a second rear panel 172 positioned inside, the housing 4 is fixed between the first rear panel 171 and the second rear panel 172, the housing 4 of the packsack damping module is fixed between the first rear panel 171 and the second rear panel 172, the upper end of the shoulder girdle 18 is connected with the first movable member 2, and the lower end of the shoulder girdle 18 is connected with the second movable member 3.

The edge of the housing 4 is provided with a threading hole 25, and the housing 4 is sewed on the first rear panel 171, wherein the middle of the rear housing 42 is provided with a plurality of positioning holes 13, the inner side of the front housing 41 is provided with a positioning post 14, the positioning post 14 is inserted and penetrates through the positioning hole 13, the end part of the positioning post 14 is provided with an opening, and the opening part of the positioning post 14 is connected with the second rear panel 172 through a plug pin (not shown in the FIG.).

The shoulder girdle 18 can be directly connected with the first movable member 2 and the second movable member 3, or as in this example, the upper end of the shoulder girdle 18 is connected with the upper end of the first movable member 2 through the connecting plate 19, and the lower end of the shoulder girdle 18 is connected with the lower end of the second movable member 3 through the connecting plate 19. The first movable member 2 and the second movable member 3 have the same structure and are both provided with a connecting portion 7, the connecting portion 7 is provided with a connecting groove 22, the inner side of the connecting plate 19 is provided with a connecting ring 23, and the connecting ring 23 is hooked in the connecting groove 22, thereby realizing the connection.

The inner side of the connecting plate 19 is provided with a vertical strip 20, both ends of the vertical strip 20 are fixed on the connecting plate 19, generally, generally, the vertical strip 20 is sewn onto the connecting plate 19. The outer side of the second rear panel 172 is provided with a horizontal strip 21, both ends of the horizontal strip 21 are fixed on the second rear panel 172, both sides of the middle of the horizontal strip 21 are vertically sewn and fixed on the second rear panel 172, sewing lines are shown as line c in the FIG., the middle of the horizontal strip 21 penetrates through the vertical strip 20, whereby the vertical strip 20 moves up and down in the middle of the horizontal strip 21. The relationship between the width a of the middle of the horizontal strip 21 and the width b of the vertical strip 20 is a−b=4−20 mm, and by setting this size relation, the connecting plate 19 can move only in the vertical direction, so as to prevent lateral movement of the knapsack damping module and improve its stability.

Because the shoulders of a human body are wider, both sides of the connecting plate 19 are provided with inclination angles 24, two shoulder girdles 18 are arranged in total, and two shoulder girdles 18 are connected to the inclination angle 24; through the setting of the inclination angle, making the shoulder girdle 18 set more in line with the principles of Ergonomics.

When the packsack is used, through the coordination of the upper and lower ends of the shoulder girdle 18 with the first movable member 2 and the second movable member 3 respectively, the damping treatment is carried out from the upper and lower directions, thereby greatly reducing the impact force brought to the shoulder by walking, thus achieving the effect of relieving the pressure, and the effect is better than the shoulder girdle 18 single-end damping. When used as a children's packsack, the position of the guide post 9 can be clearly seen through the display block 16, which can remind the parents of the packsack's load-bearing status and serve as a warning, thus caring for the healthy growth of children.

Figure 14:
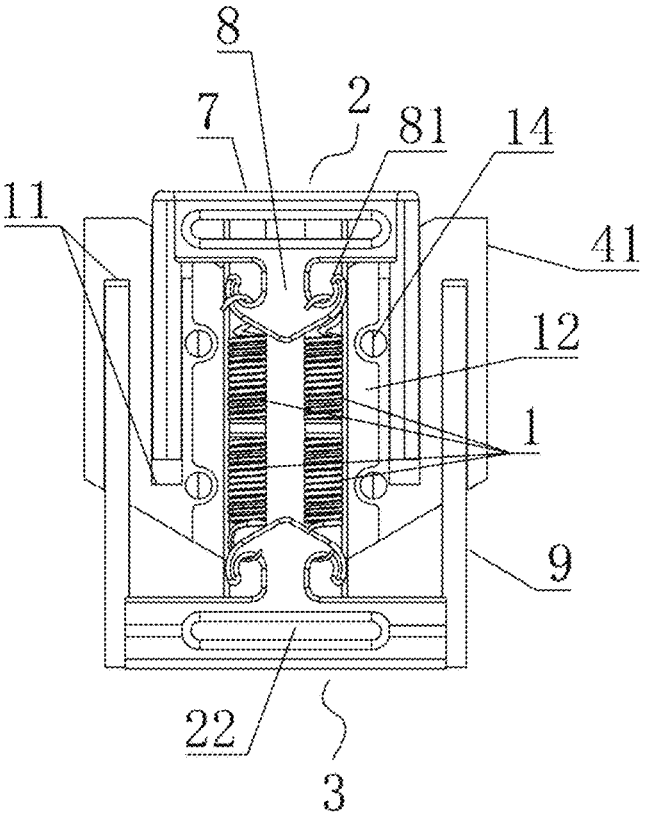
FIG. 14 is a rear view structure schematic diagram of a packsack damping module according to Example 3 of the present disclosure (excluding a rear housing).

Example 3 as shown in FIG. 14, this example differs from Example 1 in that:

the first movable member 2 and the second movable member 3 do not share the spring 1, the number of the springs 1 is four, the upper ends of the two springs 1 (first elastic member) distributed left and right at the upper part are connected with the first movable member 2, and the lower ends of the springs 1 are connected with the housing 4; two springs 1 (second elastic member) distributed left and right at the lower part are connected with the second movable member 3, and the upper end of the springs 1 are connected with the housing 4. In the case of no shared springs 1, the first movable member 2 and the second movable member 3 each use their own spring 1, which can also achieve good damping effect; relative to the case of shared springs 1, it needs to increase the number of springs 1, however, relative to the case of shared springs 1, the spring 1 replacement of the first movable member 2 and the second movable member 3 can be replaced separately and not affect each other.

Figure 15:
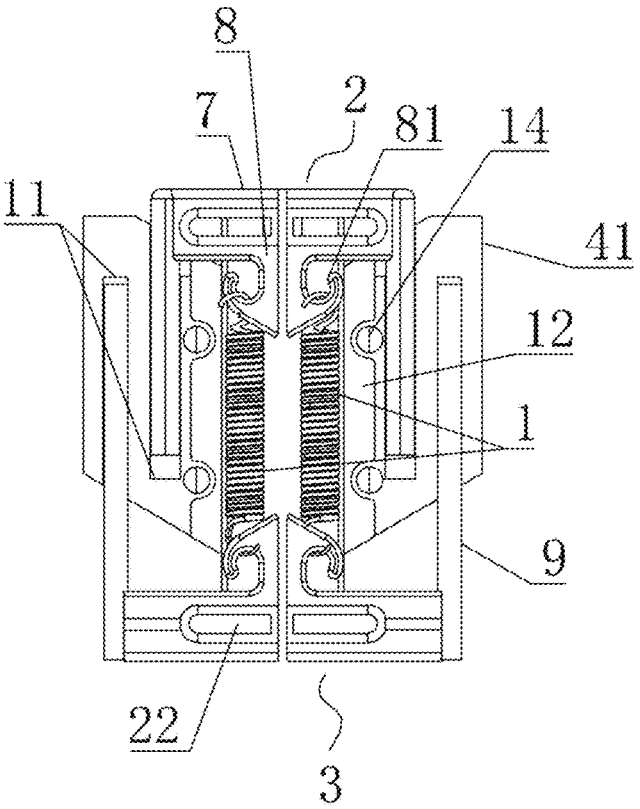
FIG. 15 is a rear view structure schematic diagram of a packsack damping module according to Example 4 of the present disclosure (excluding a rear housing).

Example 4 as shown in FIG. 15, this example differs from Example 1 in that:

there are two first movable members 2, the hanging portion 81 of the hook 8 of each first movable member 2 is one, the outer end of the connecting portion 7 of each first movable member 2 is connected with the guide post 9, and the two first movable members 2 are correspondingly connected with the upper ends of the two springs 1.

There are two second movable members 3, the hanging portion 81 of the hook 8 of each second movable member 3 is one, the outer end of the connecting portion 7 of each second movable member 3 is connected with the guide post 9, and the two second movable members 2 are correspondingly connected with the lower ends of the two springs 1.

In this example, through the arrangement of the two first movable members 2 and the two second movable members 3, compared with the Example 1, the two first movable members 2 can be directly connected with the upper ends of the two shoulder girdles 18 respectively, and the two second movable members 3 can be directly connected with the lower ends of the two shoulder girdles 18 respectively. By adopting the arrangement of the separated first movable member 2 and the second movable member 3, the shoulder girdle is more flexible when in use, and still have double spring damping effect.

Figure 16:
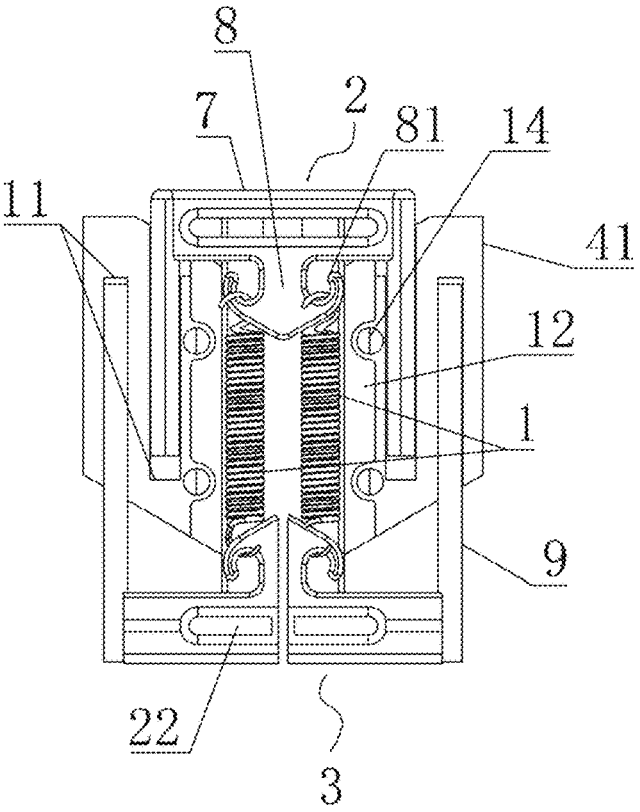
FIG. 16 is a rear view structure schematic diagram of a packsack damping module according to Example 5 of the present disclosure (excluding a rear housing).

Example 5 as shown in FIG. 16, this example differs from Example 4 in that:

there is one first movable member 2, the hook 8 of the first movable member 2 has left and right hanging portion 81, and both left and right ends of the connecting portion 7 of the first movable member 2 are connected with the guide post 9.

In this example, one first movable member 2 located at the upper part is provided, and two second movable members 3 located at the lower part are provided, so that the two upper ends of the shoulder girdle are connected to the same first movable member 2, and the stability of the upper end of the shoulder girdle is ensured while ensuring the flexibility of the lower end of the shoulder girdle.

Figure 17:
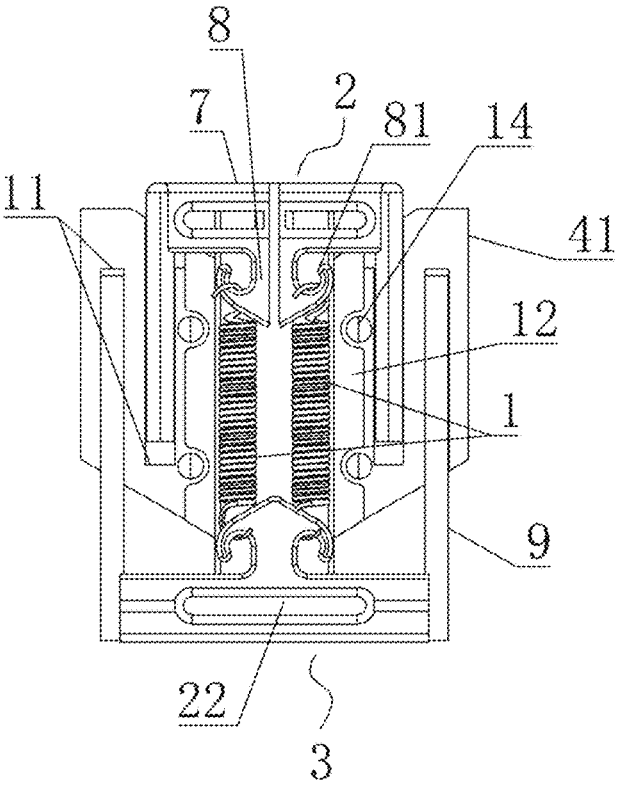
FIG. 17 is a rear view structure schematic diagram of a packsack damping module according to Example 6 of the present disclosure (excluding a rear housing).

Example 6 as shown in FIG. 17, this example differs from Example 4 in that:

there is one second movable member 3, the hook 8 of the second movable member 3 has left and right hanging portion 81, and both left and right ends of the connecting portion 7 of the second movable member 3 are connected with the guide post 9.

In this example, two first movable members 2 located at the upper part is provided, and one second movable member 3 is located at the lower part is provided, so that the two lower ends of the shoulder girdle are connected to the same second movable member 3, and the flexibility of the upper end of the shoulder girdle is ensured while ensuring the stability of the upper end of the shoulder girdle.

Figure 18:
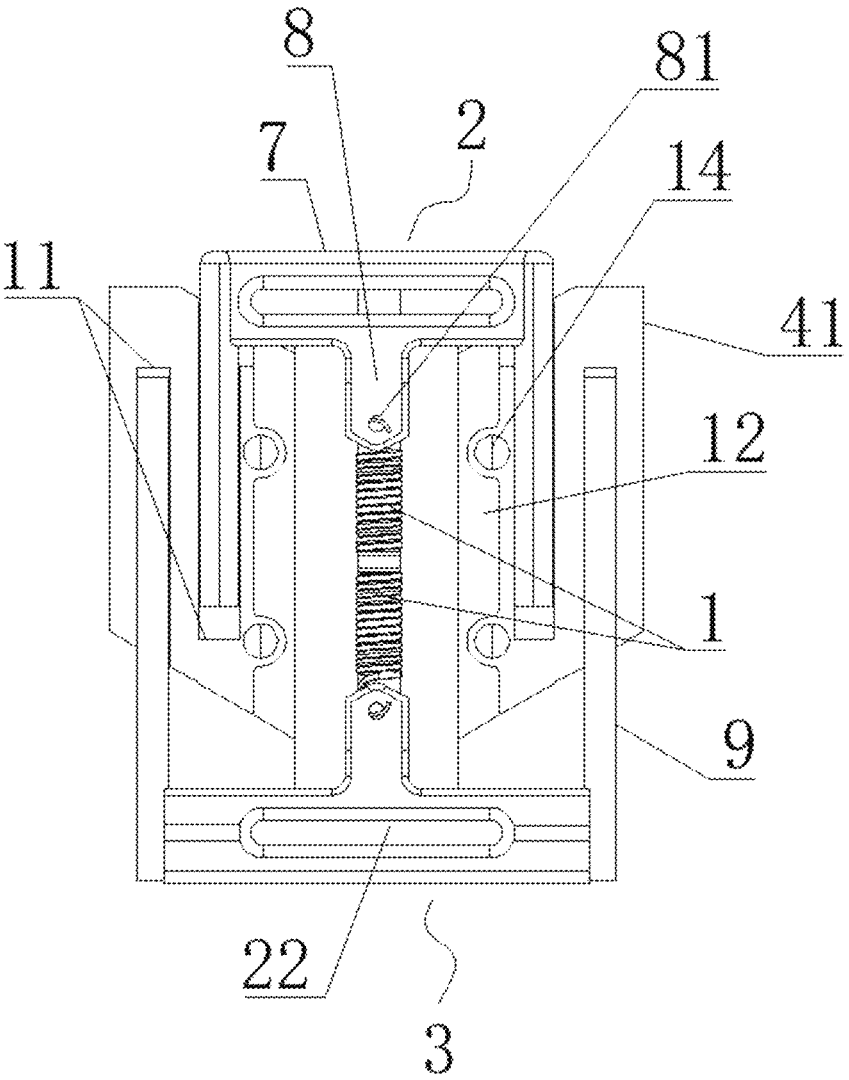
FIG. 18 is a rear view structure schematic diagram of a packsack damping module according to Example 7 of the present disclosure (excluding a rear housing).

Example 7 as shown in FIG. 18, this example differs from Example 3 in that:

the middle of the hook 8 is provided with a hanging portion 81, there are two springs 1, the upper end of the spring 1 (the first elastic member) located above is connected with the hanging portion 81 of the first movable member 2, and the lower end is connected with the housing 4; the lower end of the spring 1 (the second elastic member) located below is connected with the hanging portion 81 of the second movable member 3, and the upper end is connected with the housing 4.

The above examples are only used to illustrate the technical solutions of the present disclosure, not to limit them; although the present disclosure has been described in detail with reference to the foregoing examples, a person of ordinary skill in the art should understand that the technical solutions described in the foregoing examples can still be modified, or some technical features thereof can be replaced equivalently; and these modifications or substitutions do not deviate the essence of the corresponding technical solutions from the spirit and scope of the technical solutions of the examples of the present disclosure.

INDUSTRIAL APPLICABILITY

The damping module can be applied to a packsack, especially a packsack for outdoor travel, and has good practicability.

What is claimed is:

1. A packsack damping module comprising a housing, a movable element and an elastic element;

the housing is internally provided with a mounting cavity;

the movable element comprising at least one first movable member movable towards one side of the housing and at least one second movable member movable towards an other side of the housing;

the first movable member and the second movable member are both provided in the mounting cavity; and the first movable member is connected with the second movable member through the elastic element;

the first movable member and the second movable member both comprise a connecting portion and a guide post;

at least one end of the connecting portion is connected with the guide post; and the housing is provided with two guide grooves for a sliding connection of each guide post, respectively, wherein the first movable member and the second movable member further comprise a hook;

one side of the connecting portion is connected with the hook; and the hook is connected with the elastic element.

2. The packsack damping module according to claim 1, wherein both opposite sides of the mounting cavity are provided with an opening;

the first movable member that pass through the opening on one side of the mounting cavity moves out of/into the mounting cavity; and the second movable member that pass through the opening on other side of the mounting cavity moves out of/into the mounting cavity.

3. The packsack damping module according to claim 1, wherein the guide groove are is provided with a limiting wall;

when the first movable member moves towards the second movable member, the guide post of the first movable member is blocked by the limiting wall when sliding to a lower part of one of the guide grooves; and when the second movable member moves towards the first movable member, the guide post of the second movable member is blocked by the limiting wall when sliding to an upper part of the other of the guide grooves.

4. The packsack damping module according to claim 1, wherein the hook is provided with at least one hanging portion, and each hook is connected with the elastic elements with the same number as the hanging portion.

5. The packsack damping module according to claim 4, wherein the elastic element is a spring and at least two are provided;

when there are one of the first movable member/the second movable member, there is at least one hanging portion of the first movable member/the second movable member; and when there are at least two of the first movable member/the second movable member, there is at least one hanging portion of each of the first movable member/the second movable member.

6. The packsack damping module according to claim 5, wherein the housing comprises a front housing and a rear housing, wherein a middle of the rear housing is provided with a connecting boss, the connecting boss is positioned between the spring and the guide grooves, and the connecting boss is provided with a plurality of positioning holes;

and an inner side of the front housing is provided with a positioning post, and the positioning post is inserted into the positioning hole.

7. The packsack damping module according to claim 6, wherein:

the guide post is cylindrical, and the guide grooves comprises a first circular arc guide groove arranged on the rear housing and a second circular arc guide groove arranged on the front housing;

a circular groove is enclosed between the first circular arc guide groove and the second circular arc guide groove;

the guide post is provided in the circular groove; and the limiting wall is provided at a bottom end of the first circular arc guide groove and/or the second circular arc guide groove.

8. The packsack damping module according to claim 6, wherein the front housing is provided with an escape groove at a position of the spring.

9. The packsack damping module according to claim 6, wherein a display block for displaying a position of the guide post is installed at an end of the guide post of the first movable member; and the front housing is partially transparent or fully transparent.

10. A packsack comprising a packsack body, a shoulder girdle and the packsack damping module according to claim 1; and the housing is fixed on the packsack body, and the upper and lower ends of the shoulder girdle are respectively connected with the first movable member and the second movable member.

11. The packsack according to claim 10, wherein the housing comprises a front housing and a rear housing, wherein the middle of the rear housing is provided with a plurality of positioning holes; and the inner side of the front housing is provided with a positioning post, the positioning post is inserted and penetrates through the positioning hole, the end part of the positioning post is provided with an opening, and the opening part of the positioning post is connected with the second rear panel through a plug pin.

12. The packsack according to claim 10, wherein the packsack body comprises a first rear panel and a second rear panel positioned inside, and the housing is fixed between the first rear panel and the second rear panel.

13. The packsack according to claim 12, wherein both sides of the connecting plate are provided with inclination angles, two shoulder girdles are arranged in total, and two shoulder girdles are connected to the inclination angle.

14. The packsack according to claim 12, wherein further comprising a connecting plate, an upper end of the shoulder girdle is connected with an upper end of the first movable member through the connecting plate, and a lower end of the shoulder girdle is connected with a lower end of the second movable member through the connecting plate; and an inner side of the connecting plate is provided with a vertical strip, both ends of the vertical strip are fixed on the connecting plate, an outer side of the second rear panel is provided with a horizontal strip, both ends of the horizontal strip are fixed on the second rear panel, and the middle of the horizontal strip penetrates through the vertical strip, whereby the vertical strip moves up and down in the middle of the horizontal strip.

15. The packsack according to claim 14, wherein the first movable member and the second movable member have the same structure and are both provided with a connecting portion; and the connecting portion is provided with a connecting groove, one side of the connecting plate is provided with a connecting ring, and the connecting ring is hooked in the connecting groove.

16. A packsack damping module comprising a housing, a movable element and an elastic element;

the housing is internally provided with a mounting cavity;

the movable element comprising at least one first movable member movable towards one side of the housing and at least one second movable member movable towards the other side of the housing;

the first movable member and the second movable member are both provided in the mounting cavity;

the elastic element is provided with a first elastic member and a second elastic member, one end of the first elastic member is connected with the first movable member, and an other end of the first elastic member is connected with the housing; and one end of the second elastic member is connected with the second movable member, and an other end of the second elastic member is connected with the housing;

wherein the first movable member and the second movable member both comprise a connecting portion and a guide post;

at least one end of the connecting portion is connected with the guide post; and the housing is provided with two guide grooves for a sliding connection of each guide post, respectively, wherein the first movable member and the second movable member further comprise a hook;

one side of the connecting portion is connected with the hook; and the hook is connected with the elastic element.

17. The packsack damping module according to claim 16, wherein the hook is provided with at least one hanging portion, and each hook is connected with the elastic elements with the same number as the hanging portion.

18. The packsack damping module according to claim 17, wherein the elastic element is a spring and at least four are provided;

when there are one of the first movable member/the second movable member, there is at least two hanging portions of the first movable member/the second movable member; and when there are at least two of the first movable member/the second movable member, there is at least one hanging portion of each of the first movable member/the second movable member.

* * * * *